US011148771B2

(12) United States Patent
Nordmo

(10) Patent No.: US 11,148,771 B2
(45) Date of Patent: Oct. 19, 2021

(54) CONNECTING DEVICE FOR CONNECTING A COMPRESSED GAS CYLINDER TO AN INFLATABLE DEVICE

(71) Applicant: Safe Inflator AS, Kristiansand (NO)

(72) Inventor: Jon Nordmo, Kristiansand (NO)

(73) Assignee: Safe Inflator AS, Kristiansand (NO)

( * ) Notice: Subject to any disclaimer, the term of this patent is extended or adjusted under 35 U.S.C. 154(b) by 86 days.

(21) Appl. No.: 16/622,741

(22) PCT Filed: Jun. 14, 2018

(86) PCT No.: PCT/NO2018/050157

§ 371 (c)(1),
(2) Date: Dec. 13, 2019

(87) PCT Pub. No.: WO2018/231067

PCT Pub. Date: Dec. 20, 2018

(65) Prior Publication Data

US 2021/0147047 A1 May 20, 2021

(30) Foreign Application Priority Data

Jun. 16, 2017 (NO) ..... 20170989

(51) Int. Cl.
*B63C 9/19* (2006.01)
*B63C 9/00* (2006.01)

(52) U.S. Cl.
CPC ..... *B63C 9/19* (2013.01); *B63C 2009/007* (2013.01)

(58) Field of Classification Search
CPC ..... B63C 9/18; B63C 9/19; B63C 2009/007; B63C 2009/0029; B63C 2009/0035;
(Continued)

(56) References Cited

U.S. PATENT DOCUMENTS 4,223,805 A * 9/1980 Mackal ..... B63C 9/18 222/5
4,260,075 A * 4/1981 Mackal ..... B63C 9/18 222/5

(Continued)

FOREIGN PATENT DOCUMENTS

AU 2012261490 12/2012
DE 20216608 3/2004

OTHER PUBLICATIONS

Norwegian Search Report for NO 20170989, dated Jan. 16, 2018.
International Search Report and the Written Opinion for PCT/NO2018/050157, dated Aug. 29, 2018.

*Primary Examiner* — Andrew Polay
(74) *Attorney, Agent, or Firm* — Andrus Intellectual Property Law, LLP

(57) ABSTRACT

A connection device is for connecting a compressed gas cylinder to an inflatable device. The connection device has a releaser providing a fluid connection between the compressed gas cylinder and the inflatable device. The releaser has a primary activation mechanism for controlled puncture of the compressed gas cylinder via a piston provided with a bunching dart. The primary activation mechanism has means for axially displacement of the piston towards the compressed gas cylinder. The releaser further has: a rotatable adapter with means for irreversible fastening of the compressed gas cylinder to the adapter; a secondary trigger device adapted for puncturing the compressed gas cylinder, the secondary trigger device having a displacing means for axially displacing a trigger towards the compressed gas cylinder, where the secondary trigger device is in an activated position when the adapter is in an axially displaced position.

11 Claims, 11 Drawing Sheets

(58) Field of Classification Search
CPC .... B63C 2009/0041; B63C 2009/0047; B63C 2009/0052; B63C 2009/0058; B63C 2009/0064
See application file for complete search history.

(56) References Cited

U.S. PATENT DOCUMENTS

| | | | | |
|---|---|---|---|---|
| 5,816,878 | A | 10/1998 | McNamee | |
| 5,921,835 | A * | 7/1999 | Gordon | B63C 9/18 441/95 |
| 6,589,087 | B2 * | 7/2003 | Mackal | B63C 9/18 222/5 |
| 9,045,207 | B2 * | 6/2015 | Anderson | B63C 9/19 |
| 9,499,244 | B2 * | 11/2016 | Best | B63C 9/18 |
| 2003/0049981 | A1 | 3/2003 | Mackal et al. | |
| 2011/0000550 | A1 | 1/2011 | Rogier et al. | |
| 2012/0073466 | A1 | 3/2012 | Wang | |
| 2013/0316605 | A1 | 11/2013 | Best | |
| 2017/0029081 | A1 | 2/2017 | Michalski | |

* cited by examiner

CONNECTING DEVICE FOR CONNECTING A COMPRESSED GAS CYLINDER TO AN INFLATABLE DEVICE

CROSS-REFERENCE TO RELATED APPLICATIONS

This application is the U.S. national stage application of International Application PCT/NO2018/050157, filed Jun. 14, 2018, which international application was published on Dec. 20, 2018, as International Publication WO 2018/231067 in the English language. The International Application claims priority of Norwegian Patent Application No. 20170989, filed Jun. 16, 2017. The international application and Norwegian applications are all incorporated herein by reference, in entirety.

FIELD

This invention concerns a connecting device for connecting a compressed gas cylinder to an inflatable device via a releaser. The inflatable device is filled with gas from the gas cylinder upon activation of the releaser. More particularly, the invention concerns a releaser provided with a rotatable adapter for connecting the compressed gas cylinder to the releaser and a trigger adapted for puncturing the compressed gas cylinder. The gas cylinder is irreversibly fastened to the adapter. Upon removal of the gas cylinder by turning the gas cylinder in the opposite direction of fastening the gas cylinder, the trigger is released by turning the adapter. The invention prevents unauthorized removal of the gas cylinder from the inflatable device. The invention further provides a method for detection of a tampered gas cylinder and releaser connection. The inflatable device may be a life vest. In particular the life vest may be a life vest for use in an aircraft.

BACKGROUND

A passenger aircraft is, as a standard, provided with a life vest for each passenger. These life vests are placed under each passenger's seat. Each life vest is provided with at least one gas cylinder. The life vest is inflated with gas from the gas cylinder by pulling a releasing cord. The releasing cord activates a releaser that is provided with means for puncturing the gas cylinder. The releaser forms a channel from the gas cylinder to the interior of the inflatable vest.

Airport authorities and airlines spend substantial efforts on security checks of passengers prior to boarding an aircraft. Liquids are only allowed in small quantities. The passengers are not allowed to bring with them weapons or potential weapons such as pointed items.

It is known that compressed gas may be used as a propellant in weapons, such as an air gun. Primitive air gun like weapons may be constructed where a known gas cylinder is used as source for compressed air. Such primitive weapons may be assembled on board an airplane from parts that by themselves do not look like a weapon. The gas cylinder in a life vest may complete the weapon.

SUMMARY

The invention has for its object to further increase safety on board an airplane by eliminating the risk that the gas cylinders are used as part of a weapon.

The object is achieved through features, which are specified in the description below and in the claims that follow.

The invention relates more particularly to a connection device for connecting a compressed gas cylinder to an inflatable device, where the connection device comprises a releaser providing a fluid connection between the compressed gas cylinder and the inflatable device, the releaser comprises a primary activation mechanism for controlled puncture of the compressed gas cylinder via a piston provided with a bunching dart, said primary activation mechanism is provided with means for axially displacement of the piston towards the compressed gas cylinder, wherein the releaser further comprises:

- a rotatable adapter with means for irreversible fastening of the compressed gas cylinder to the adapter;
- a secondary trigger device adapted for puncturing the compressed gas cylinder, said secondary trigger device comprising a displacing means for axially displacing a trigger towards the compressed gas cylinder, where the secondary trigger device is in an activated position when the adapter is in an axially displaced position.

In a first embodiment the trigger may comprise the piston, and the displacing means may comprise a release lever connecting the adapter to the piston, such that the adapter in the axially displaced position has displaced the release lever and the piston axially towards the compressed gas cylinder and punctured the compressed gas cylinder.

The adapter may be provided with an external spiral groove forming a spiral face, and the release lever may be provided with an engaging dog, and the engaging dog may abut the spiral face. The release lever is provided with a gripping fork at the opposite end of the engaging dog. The gripping fork may abut a shoulder portion in the piston.

In a second embodiment the trigger may comprise a pin formed with a pointed portion; and the displacing means may comprise a spring axially forcing the pointed portion towards the adapter, and wherein

- the pin in an inactivated position may abut a top face of the adapter in a locking position; and
- the pin in an activated position may be axially displaced towards the pointed portion, such that the spring has axially displaced the pin towards the compressed gas cylinder and punctured the compressed gas cylinder when the adapter is in the axially displaced position. When the adapter is displaced axially the adapter is in an unlocking position.

The spring may be a coil spring forcing towards a spring collar of the pin.

The connection device may comprise an attachment device for fastening the releaser to the inflatable device, wherein the attachment device may be connected to the inflatable device via a screw type coupling up, said coupling up may comprise a spring hinged catch lever provided with a first lock surface and a number of rachets, and each of the rachets may be provided with a second lock surface, said second lock surface may be adapted for engagement with the first lock surface, and the spring hinged catch lever may be provided with a compression surface which may be adapted to engage with a tapered tip of a tool such that the first lock surface may be released from the second lock surface.

A connection device as described above will make an inflatable device filled with compressed gas upon an attempt of unauthorized separation of the compressed gas cylinder from the releaser. This will be easily recognizable. As an alternative, a tamperproof connection between the compressed gas cylinder and the inflatable device may be achieved by applying a locking means to the external threads of the compressed gas cylinder and the threads of a releaser of known prior art. The compressed gas cylinder will be irreversibly fastened to the releaser. The locking means may be a glue such as a thread locker. However, without further measure, this will make the compressed gas cylinder irreversible fastened to the inflatable device via the releaser even for authorized personnel. Service and maintenance of the inflatable device, releaser and compressed gas cylinder will thereby not be possible. As an alternative the compressed gas cylinder may be irreversible fastened to the releaser as described above, but the releaser may be releasable connected to the inflatable device via a coupling up. The coupling up may be a bayonet lock. The coupling up may be a threaded coupling up type. The inflatable device may be provided with a male portion with an external thread and the releaser may be provided with a female portion with an internal thread. It is also possible that the releaser may be provided with a male portion with an external thread and the inflatable device may be provided with a female portion with an internal thread. The internal thread mates with the external threads. Thereby the releaser comprising the compressed gas cylinder is releasable from the inflatable device. A through hole in the inflatable device is aligned with a corresponding through hole in the releaser. The coupling up is made tamperproof by a locking means that allows the releaser to be screwed onto the inflatable device in one rotational direction, but the locking means block for unscrewing the releaser in the opposite direction. The coupling up is further provided with means for operating the locking means between a blocking position and a disengaged position. The means may be a key hole with an irregular profile, and authorized personnel may use a specially designed release tool that fits complementary to the key hole to disengage the locking means. The locking means may comprise a spring hinged catch lever provided with a first lock surface. The locking means may further comprise a number of rachets, each rachet is provided with a second lock surface. When the releaser is screwed onto the inflatable device, the rachets slide freely over the catch lever. When the releaser is screwed in the opposite direction, the first lock surface and the second lock surface abut and block for unscrewing. The release tool moves the catch lever away from the rachets and unscrewing is thereby possible.

When the inflatable device comprises the male portion, the key hole may be positioned in the wall of an outer sleeve that surrounds the through hole in the inflatable device. The release tool may on operation be displaced radially through the key hole and may press the catch lever towards the inflatable device. When the releaser comprises the male portion, the key hole may be positioned in the wall of an outer sleeve that surrounds the through hole in the releaser. The release tool may on operation be displaced radially through the key hole and may press the catch lever towards the releaser.

BRIEF DESCRIPTION OF THE DRAWINGS

In the following is described examples of preferred embodiments illustrated in the accompanying drawings, wherein.

DETAILED DESCRIPTION OF THE DRAWINGS

Figure 1:
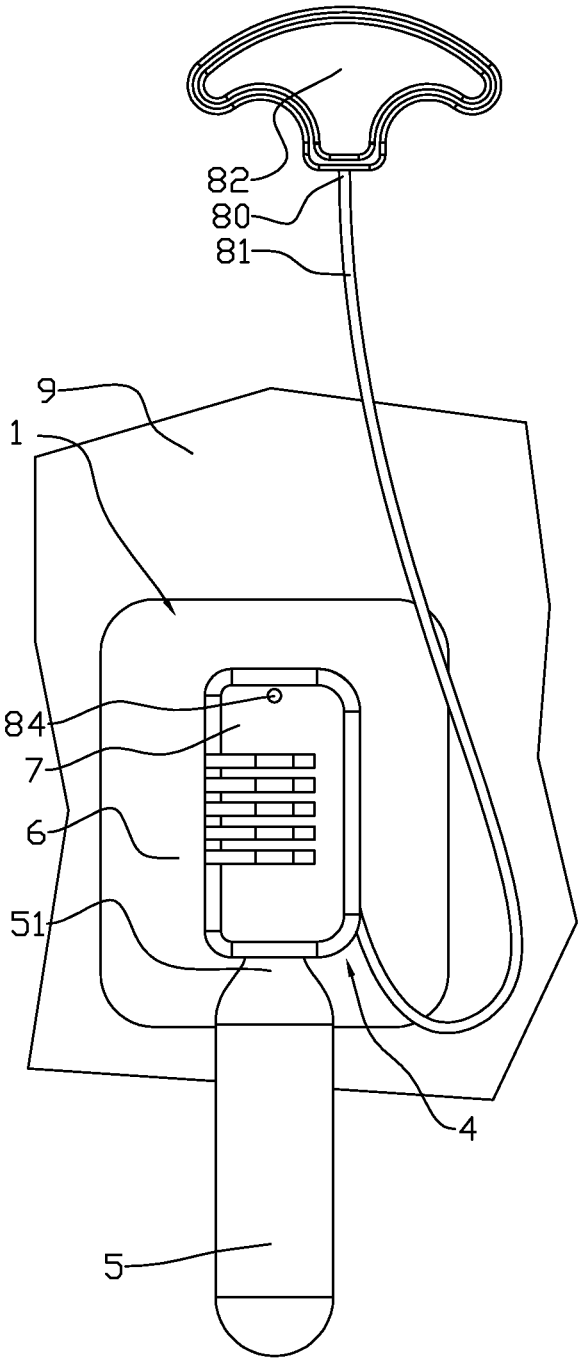
FIG. 1 shows in front view a compressed gas cylinder and a releaser for connecting the compressed gas cylinder to an inflatable device by an attachment device.

In the drawings, the reference numeral 1 indicates a connection device according to the invention. The connection device 1 comprises an adapter 2, a secondary trigger device 3, both positioned within a releaser 4. A compressed gas cylinder 5 is fastened to the releaser 4, and the releaser 4 is fastened to an inflatable device 9 by an attachment device 6. The releaser 4 comprises a house 7 connected to the attachment device 6. The attachment device 6 and the house 7 may be formed in one material piece as shown in the drawings.

The releaser 4 further comprises a primary activation mechanism 8 for controlled release of compressed gas from the compressed gas cylinder 5 to the inflatable device 9 through the releaser 4.

The primary activation mechanism 8 is per se a known activation mechanism 8 and comprises a releasing cord 81, which at its free end 80 is provided with a handle 82. In the opposite fixed end 89, the releasing cord 81 is fastened to a trigger 83 which pivots around a trigger axis 84. In the figures the trigger 83 is shown as an L-shaped arm where the releasing cord 81 is fastened to the long portion of the L-shaped arm and a hole 85 for the trigger axis 84 is provided in the short portion of the L-shaped arm. Upon activation, i.e. by pulling the releasing cord 81, the trigger 83 pivots in the direction indicated by an arrow in FIGS. 6-9. The short portion of the L-shaped arm is provided with a cam lobe 87.

Figure 2:
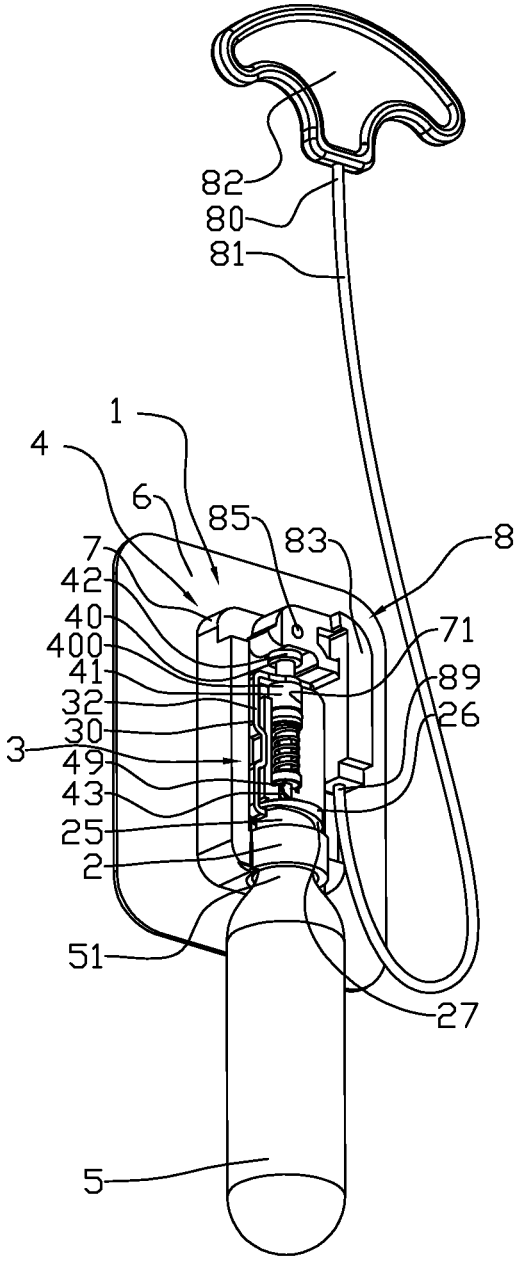
FIG. 2 shows in a perspective view releaser as shown in FIG. 1 where a portion of a house is cut away to display a primary activation mechanism and a secondary trigger device.
Figure 3:
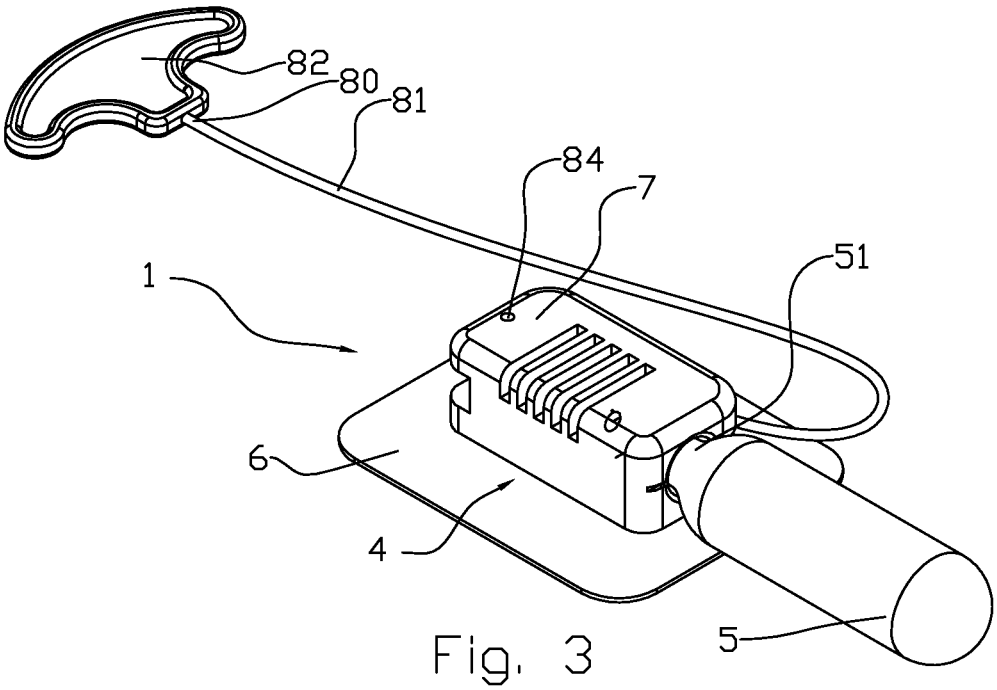
FIG. 3 shows in another perspective view the compressed gas cylinder and the releaser.
Figure 4:
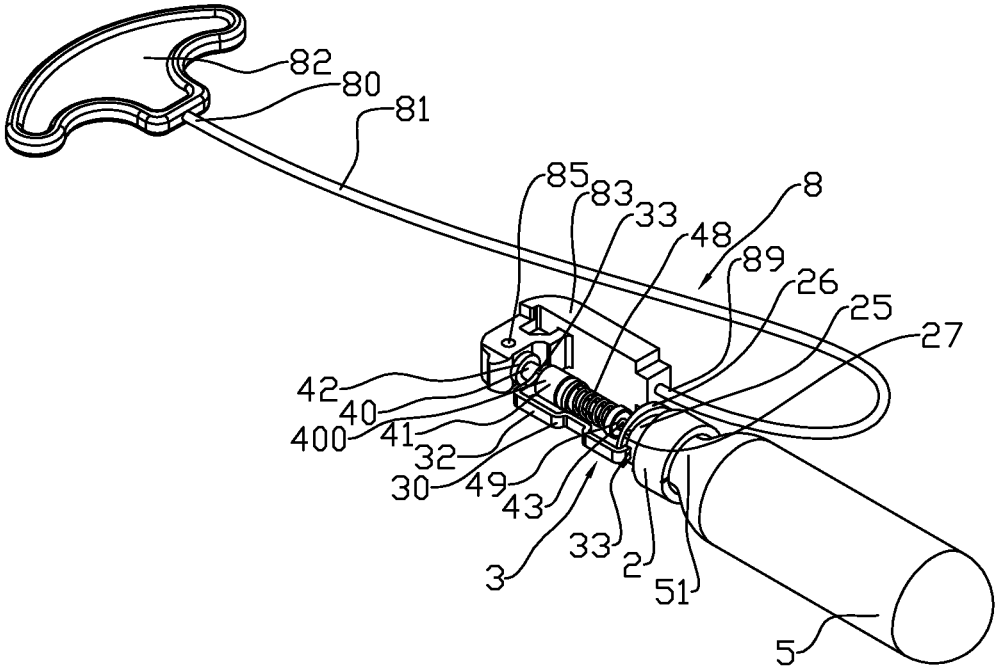
FIG. 4 shows in the same view as FIG. 3, where the house and the attachment device have been removed to display the components of the primary activation mechanism, the secondary trigger device and the gas cylinder.
Figure 5:
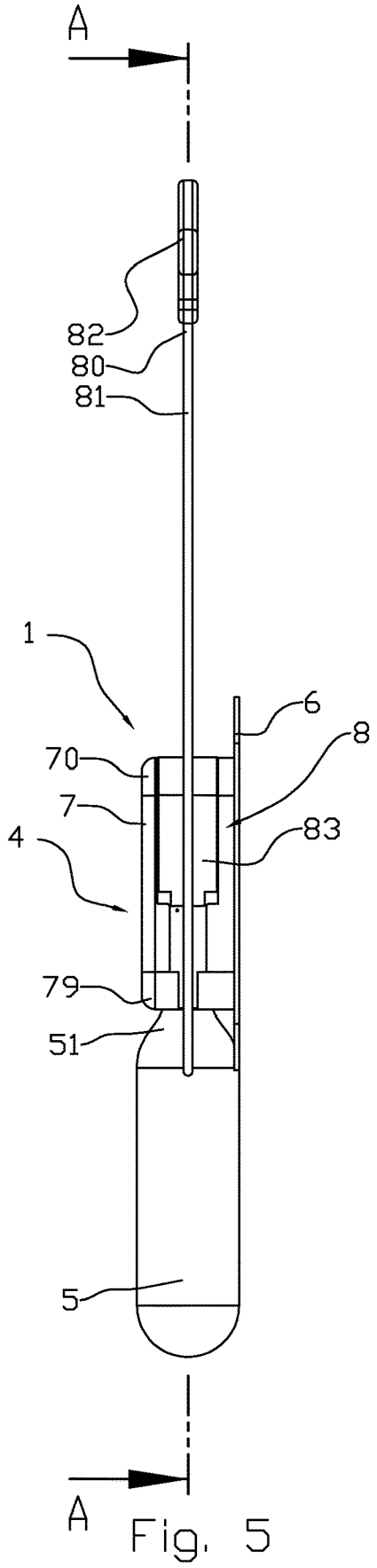
FIG. 5 shows in side view the compressed gas cylinder and the releaser.
Figure 6:
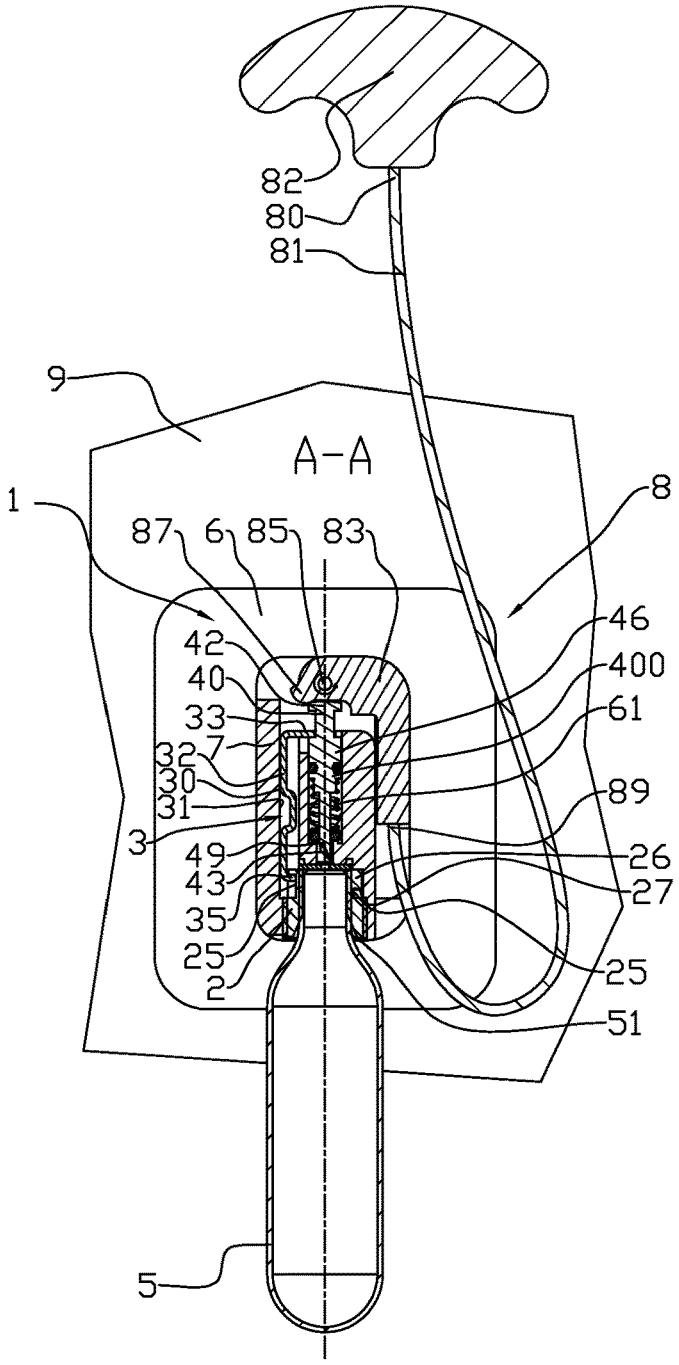
FIG. 6 shows in the same scale as FIG. 4, a sectional drawing along line A-A of FIG. 5.
Figure 7:
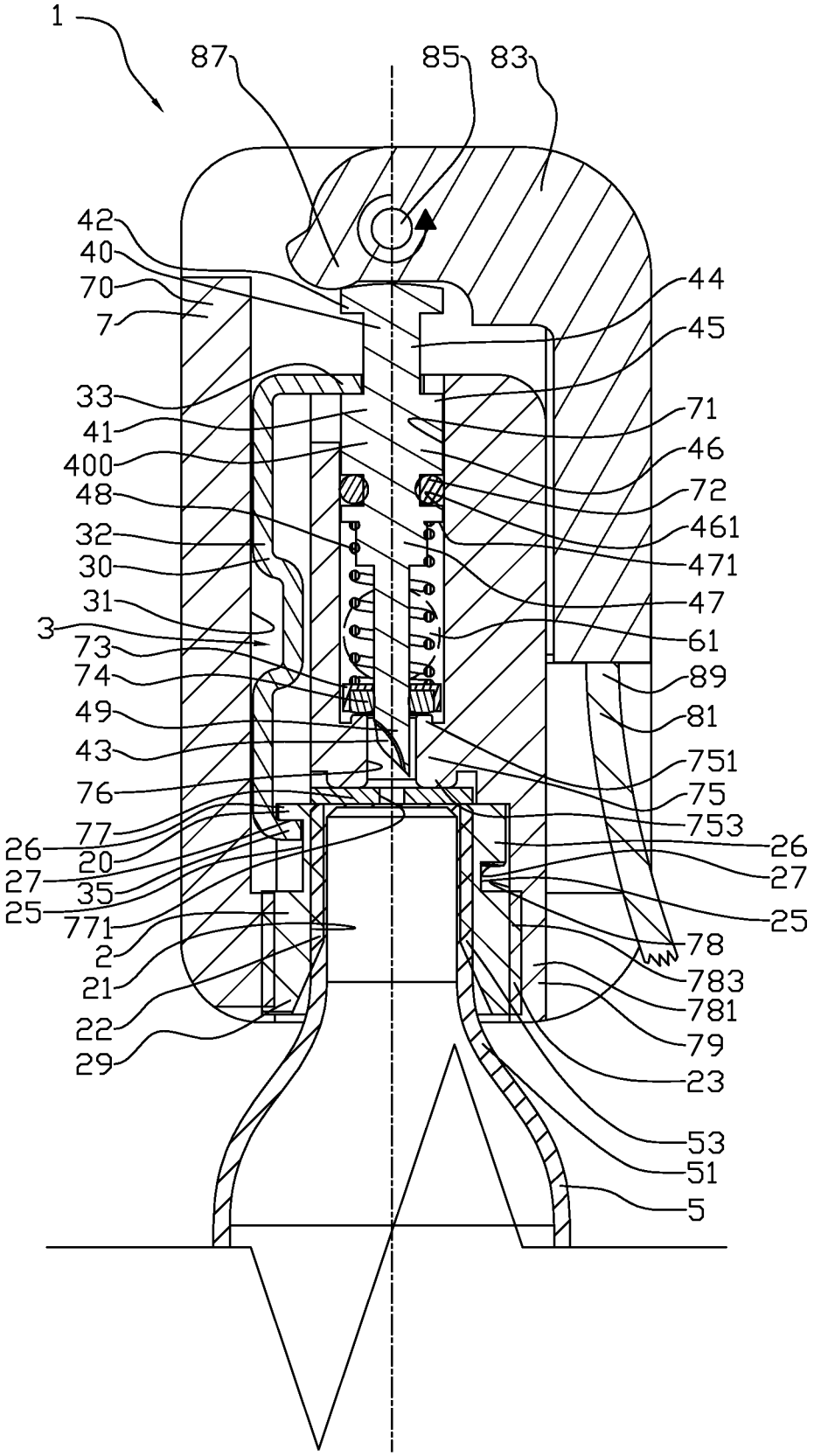
FIG. 7 shows in a larger scale the releaser and the connection device.

The releaser 4 further comprises a piston 41, see FIGS. 2 and 4. The piston 41 comprises a first end portion 40 with a terminal engagement head 42 and at the opposite second end portion 49 with a bunching dart 43. The house 7 is formed with a central piston channel 71 and the piston 41 is axially displaceable in the piston channel 71.

Further details of the piston 41 will be described from the first end portion 40 towards the second end portion 49. The first end portion 40 is formed with a neck portion 44 adjacent the terminal engagement head 42 (see FIGS. 7-9). The neck portion 44 is formed with a diameter that is less than the terminal head 42. At the opposite end the neck portion 44 is terminated in a shoulder portion 45. A piston body 46 is formed from the shoulder portion 45 towards the second end portion 49. A circumferential groove 461 is formed in the piston body 46. The groove 461 houses a sealing element 72, such as an O-ring. The sealing element 72 is in engagement with the piston channel 71.

A radially reduced portion 47 forms a surface 471 facing the end portion 49. The bunching dart 43 protrudes from the radially reduced portion 47. The diameter of the bunching dart 43 is less than the diameter of the radially reduced portion 47. A displaceable seal holder 73 houses a sliding seal 74. The seal holder 73 is provided with a hole and is axially displaceable along the bunching dart 43. The seal holder 73 is closed towards the first end portion 40 and open towards the second end portion 49. The sliding seal 74 seals towards the second end portion 49. A primary compression coil spring 48 is positioned between the surface 471 and the seal holder 73 and around the bunching dart 43.

The piston channel 71 is terminated in an annular sealing shoulder 75 formed with a central bore 76 for the bunching dart 43. The annular sealing shoulder 75 forms on the side facing the first end portion 70 a first annular valve seat 751 for the sliding seal 74. The annular sealing shoulder 75 forms on the side facing the second end portion 79 a second annular valve seat 753 for a disc seal 77. The disc seal 77 is provided with a central through opening 771.

The house 7 is further at the second end portion 79 provided with a receiving chamber 78. The receiving chamber 78 is shown coaxial with the piston channel 71. The bore 76 and the through opening 771 forms a fluid channel between the receiving chamber 78 and the piston channel 71. The receiving chamber 78 is at the mouth portion 781 provided with fastening means 783 for releasable fastening of the adapter 2. The fastening means 783 is shown as a threaded portion.

The adapter 2 is formed with a first end portion 20 and a second end portion 29. The adapter 2 is further provided with a through opening 21 from the first end portion 20 to the second end portion 29. The through opening 21 is shown coaxial with the piston channel 71 and the receiving chamber 78. The through opening 21 is provided with internal fastening means 22 for fastening the compressed gas cylinder 5. The internal fastening means 22 is shown as threads that are complementary to threads 53 on the external face of a bottleneck 51. The through opening 21 is shown with a wider portion at the second end portion 29 to accommodate the bottleneck 51 when the compressed gas cylinder 5 is connected to the adapter 2.

The adapter 2 is at the outside face of the second end portion 29 provided with an external releasable fastening means 23. The external releasable fastening means 23 is complementary to the fastening means 783 in the second end portion 79 of the house 7. The external releasable fastening means 23 is shown as a threaded portion.

The adapter 2 is in a first embodiment at the first end portion 20 provided with an external spiral groove 25 as seen in FIGS. 2, 4, 6 and 7. The spiral groove 25 forms a spiral flange 26 forming a spiral side 27 facing the second end portion 29.

The house 7 is in a first embodiment further provided with a passage 31 for a displacing means 30. The displacing means 30 is in this embodiment shown as a release lever 32. The release lever 32 is axially displaceable within the passage 31. The release lever 32 is at one end formed with gripping fork 33 that is positioned around a portion of the neck portion 44 and abutting the shoulder portion 45 of the piston 41. The gripping fork 33 is shown perpendicular to the longitudinal direction of the release lever 32. The release lever 32 is at the opposite end provided with an engaging dog 35. The engaging dog 35 is shown perpendicular to the longitudinal direction of the release lever 32. The engaging dog 35 is in position of use abutting the spiral face 27.

The piston channel 71 is provided with a through opening 61 which provides a fluid channel (not shown) from the piston channel 71 to the inflatable device 9 seen in FIG. 1. The inflatable device 9 may be a life vest.

The releaser 4 is assembled by positioning the seal holder 73, the primary spring 48 and the piston 41 in the piston channel 71 while the gripping fork 31 is positioned around the neck portion 44 and the release lever 32 is positioned in the passage 78. The adapter 2 is positioned in the receiving chamber 78 and fastened such that the compressed gas cylinder 5 abuts the disc seal 77. The spiral flange 26 is terminated at the first end portion 20 such that the engaging dog 33 enters the spiral side 27 when the adapter 2 is twisted or rotated into the receiving chamber 78.

A locking means is applied to the external threads 53 and the compressed gas cylinder 5 is irreversibly fastened to the adapter 2. The locking means may be a glue such as a thread locker.

Figure 8:
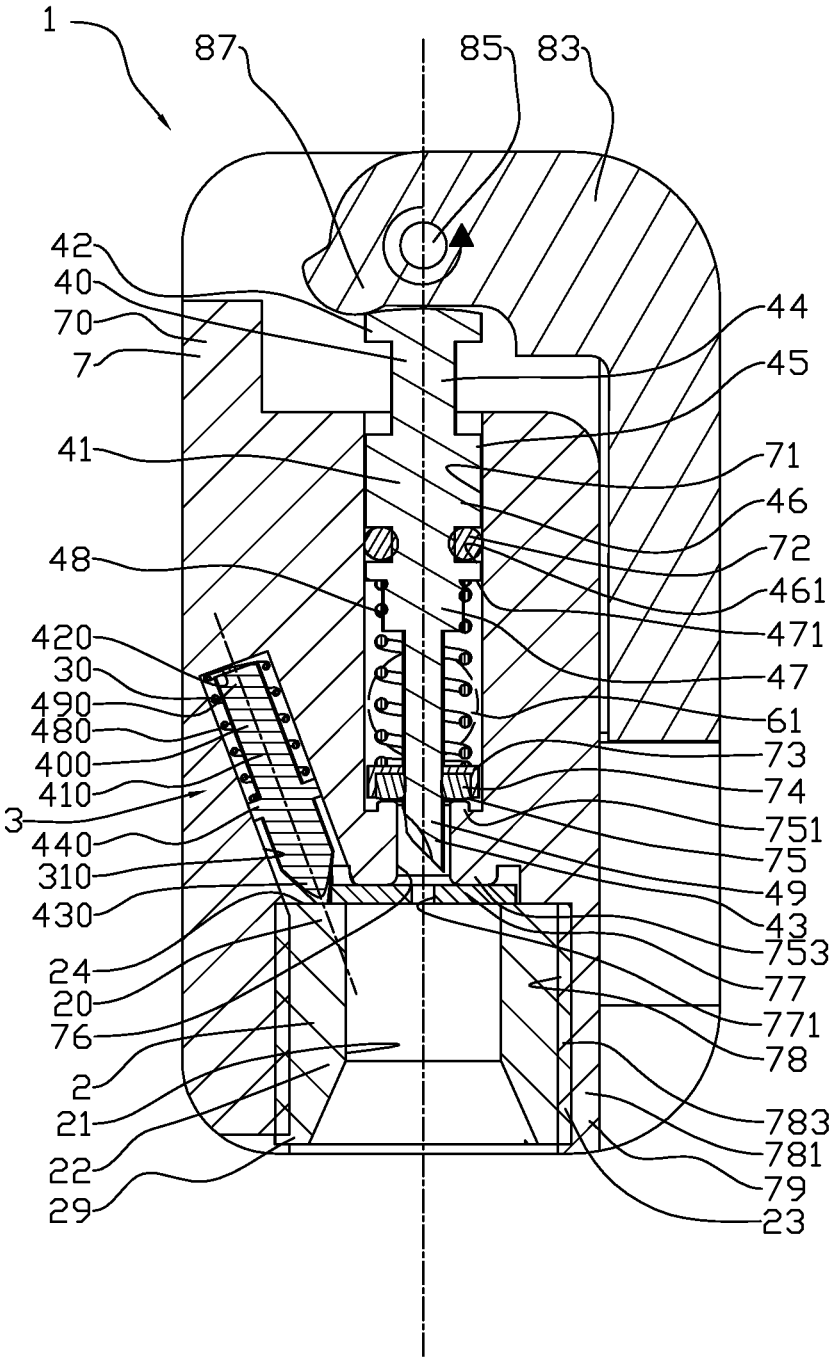
FIG. 8 shows in the same scale as FIG. 7 in a second embodiment, the releaser with an adapter in a passive position.
Figure 9:
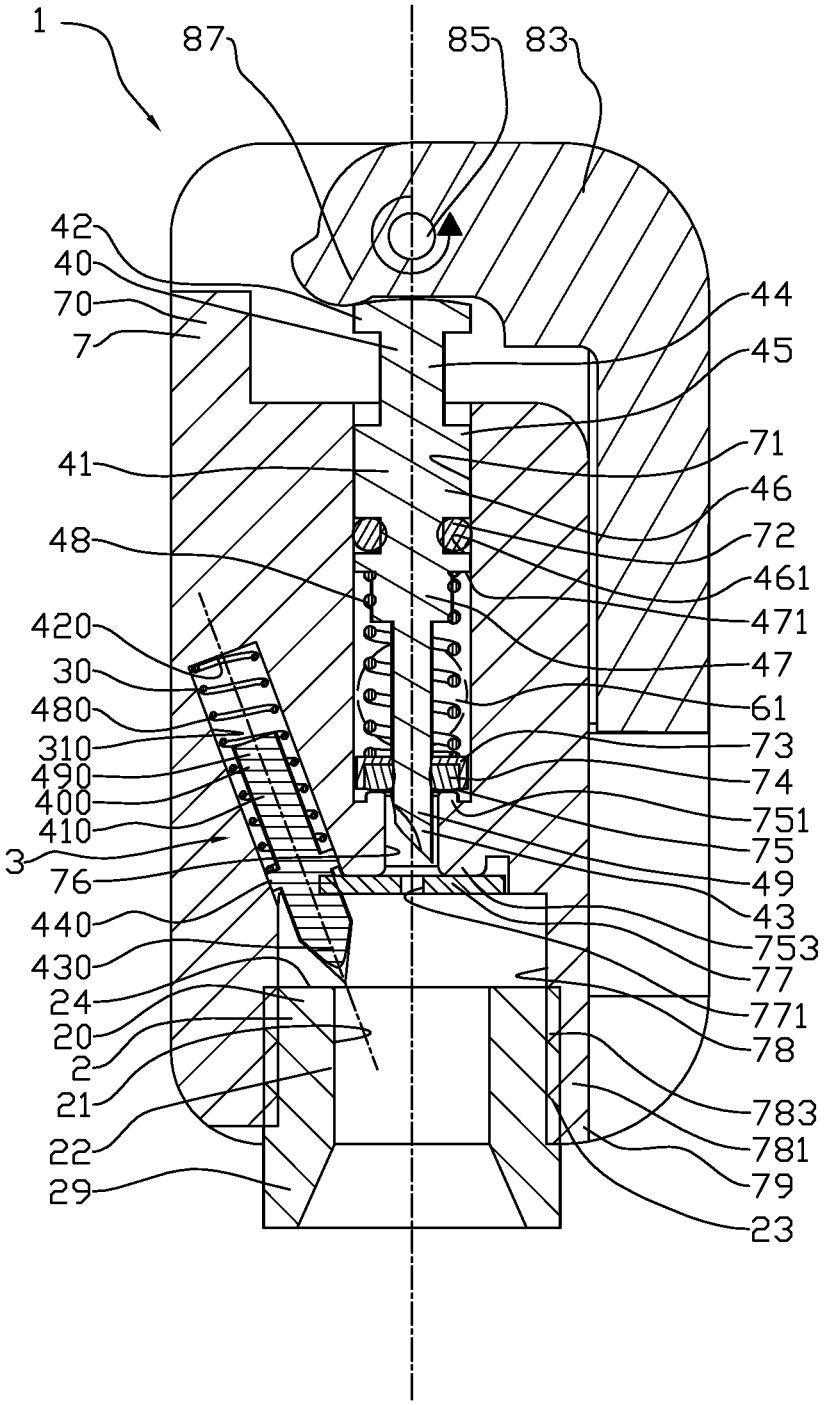
FIG. 9 shows the releaser shown in FIG. 8 with the adapter in an active position.

The house 7 is in a second embodiment provided with a cavity 310 for a pin 410, see FIGS. 8 and 9. The cavity 310 forms an opening towards the receiving chamber 78, and an end wall 420 at the opposite end. The pin 410 is formed with a pointed end 430 and an opposite end portion 490. The pointed end 430 faces the receiving chamber 78. The pin 410 comprises a projecting spring collar 440 between the pointed end 430 and the opposite end portion 490. A spring 480, shown as a coiled spring, is positioned around the pin 410 between the spring collar 440 and the end wall 420. The spring 480 abuts the end wall 420 and the spring collar 440. When the pin 410 is in an inactivated position, as shown in FIG. 8, the spring 480 is tensioned and biases the pin 410 towards the receiving chamber 78. The pointed end portion 430 abuts a top face 24 of the adapter 2 when the pin 410 is in the inactivated position. When the adapter 2 is displaced axially in the receiving chamber 78, the spring 480 displaces the pin 410 towards the receiving chamber 78 as shown in FIG. 9.

Figure 10:
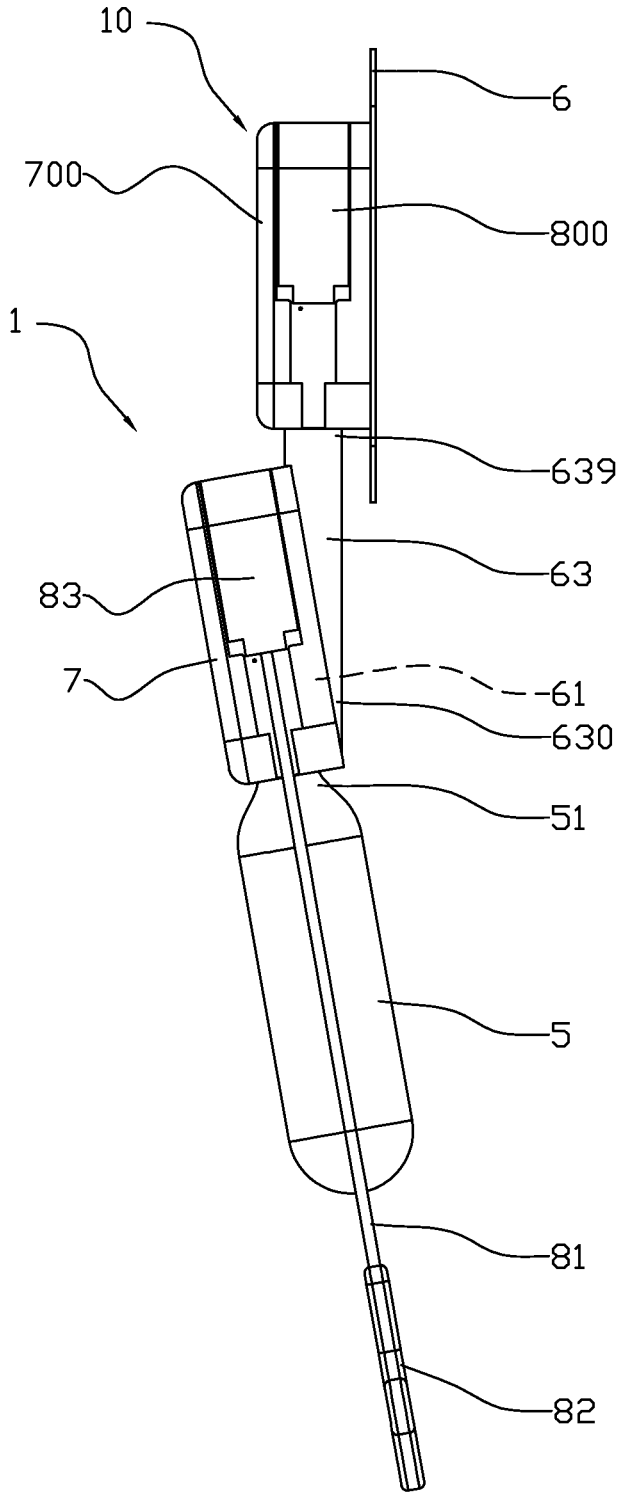
FIG. 10 shows in a different scale a releaser according to the invention connected to a known releaser.
Figure 11A:
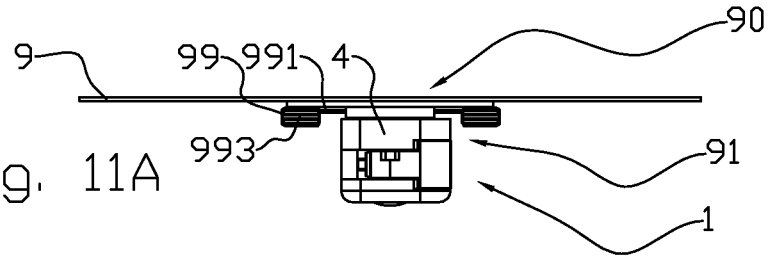
FIG. 11A-C show in a different scale the releaser fastened to the inflatable device via a coupling up.
Figure 11B:
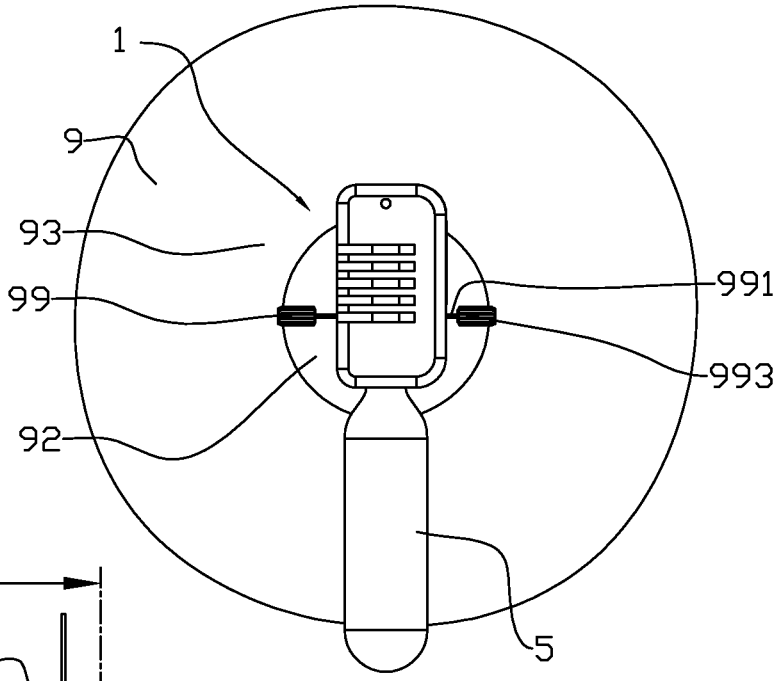
Figure 11C:
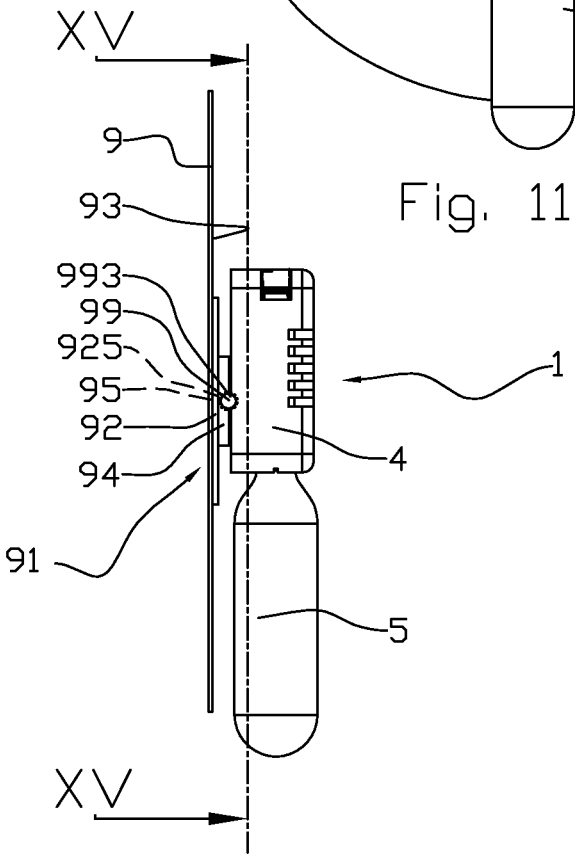
Figure 12:
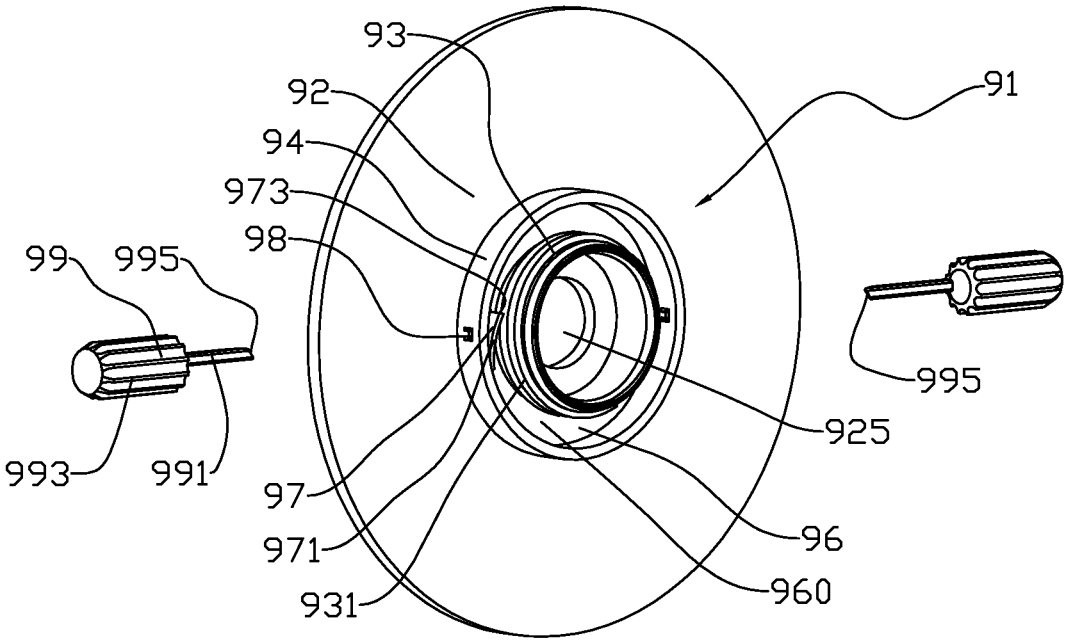
FIG. 12 shows a flange connection of the coupling up and a release tool.
Figure 13:
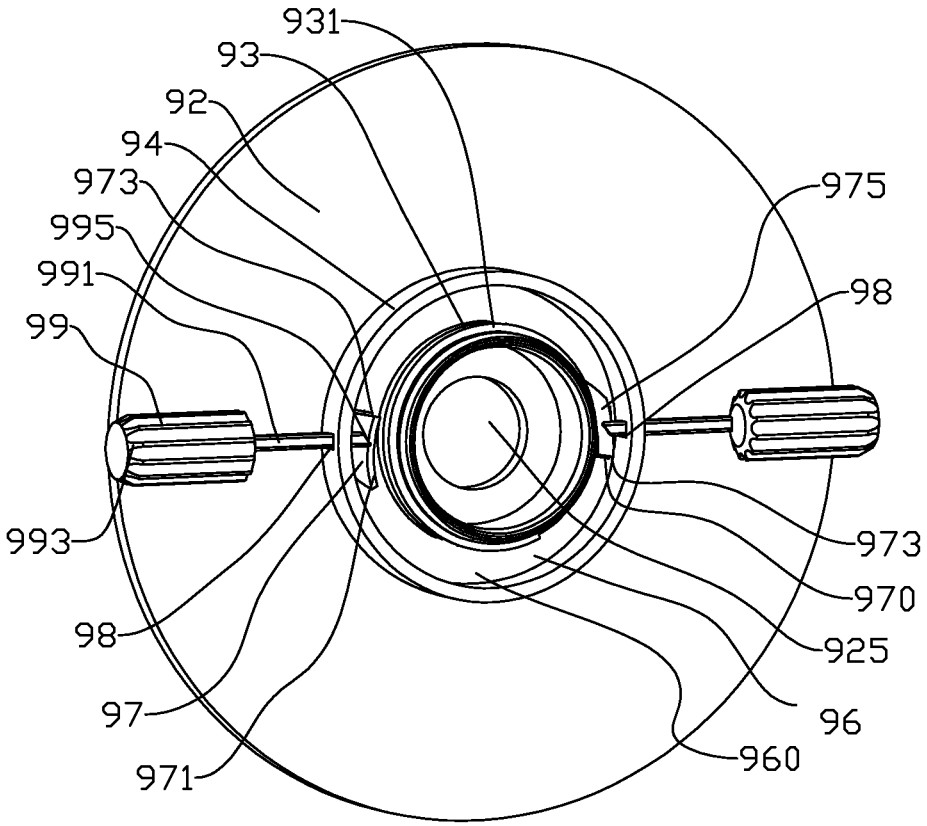
FIG. 13 shows the same as FIG. 12 where the release tool is positioned in a key hole.
Figure 14:
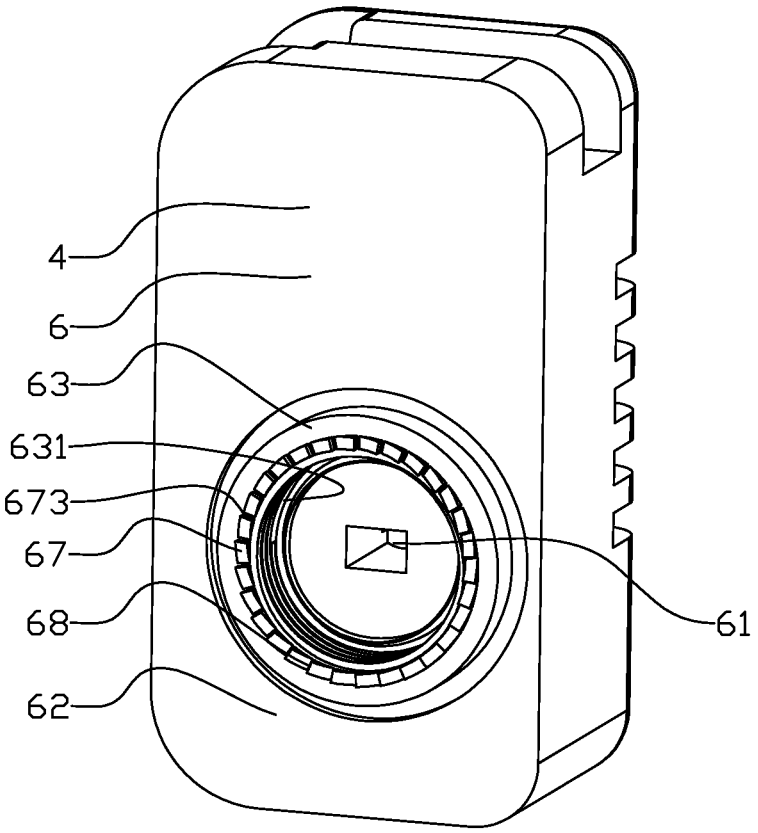
FIG. 14 shows a connection face of the releaser.
Figure 15:
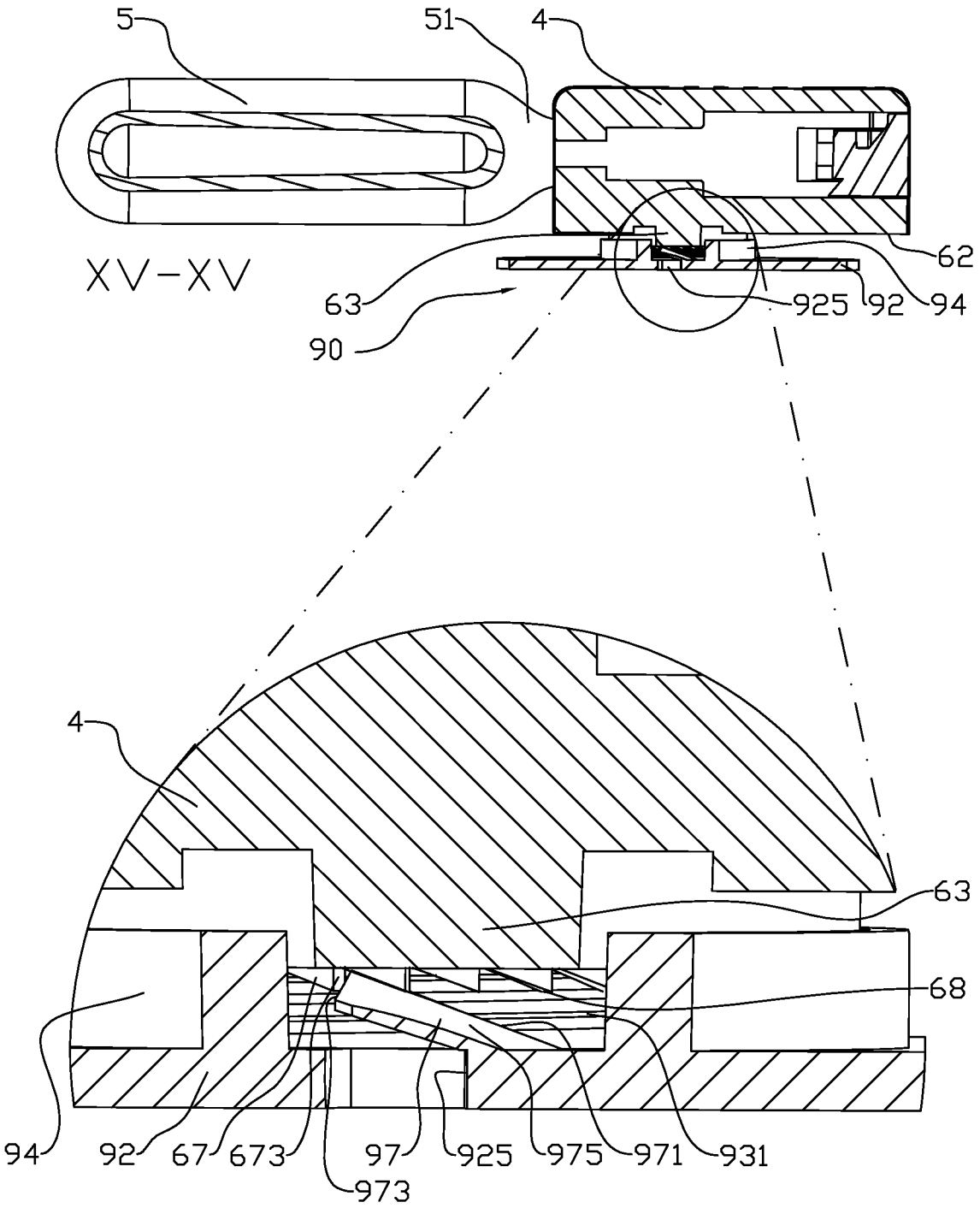
FIG. 15 shows in a large scale a locking mechanism comprising a catch lever and a number of rachets that allow turning the releaser in one direction around a threaded connection and block the releaser from being turned in the opposite direction.

The invention is shown in an alternative embodiment in FIG. 10. In this embodiment the invention is adapted to be fitted to a connection device 10 of a known inflatable device 9. The connection device 10 comprises a house 700 and a primary activation mechanism 800. The releasing cord of the connection device 10 has been removed. The connection device 1 according to the invention is provided with a connection channel 63. The connection channel 63 is at a first end portion 630 connected to the through opening 61 and at an opposite second end portion 639 provided with threads (not shown) that engage with threads in the connection device 10. The threads at the second end portion 639 may be external threads. The threads in the connection device 10 may be internal threads adapted to receive the external threads 53 of a compressed gas cylinder 5.

In normal operation the inflatable device 9 is filled with gas from the compressed gas cylinder 5 by engaging the trigger 83. A pull in the handle 82 rotates the trigger 83 around the trigger axis 84. The cam lobe 87, which abuts the engagement head 42, displaces the piston 41 towards the second end portion 79. The spring 48 is compressed between the piston body 46 and the seal holder 73. The bunching dart 43 is forced through the opening 771 in the disc seal 77 and further into the compressed gas cylinder 5 until the compressed gas cylinder 5 is punctured. Compressed gas flows towards the piston channel 71 through the bore 76 and lifts the sliding seal 74 off the first valve seat 751. The seal holder 73 is displaced along the bunching dart 43 towards the first end portion 70 together with the sliding seal 74, and the primary spring 48 is further compressed. Compressed gas in the piston channel 71 enters the inflatable device 9 through the through opening 61. The sealing element 72 secures that compressed gas is not released from the first end portion 70 through the piston channel 71.

When the force of the compressed primary spring 48 on the seal holder 73 exceeds the force of the remaining compressed gas in the compressed gas cylinder 5, the sliding seal 74 closes the passage through the bore 76 by abutting the annular valve seat 751. The compressed gas in the inflatable device 9 is confined as the sliding seal 74 and the sealing element 72 block for passage out through the releaser 4.

The invention prohibits unauthorized release of the compressed gas cylinder 5 from the inflatable device 9. Twisting, turning or screwing the compressed gas cylinder 5 in a direction that under ordinary circumstances will unscrew or release the compressed gas cylinder 5 from the releaser 4, will be unsuccessful. The adapter 2 will turn together with the compressed gas cylinder 5 due to the locking means. By turning the adapter 2, the adapter 2 will be displaced axially to an active position. In the first embodiment the displacing means 30 comprising the engaging dog 33 will be displaced towards the second end portion 79 as the engaging dog 33 abuts and rides on the spiral side 27. The displacing means 30 comprises further the release lever 32 and the gripping fork 33 which are displaced together with the engaging dog 33. The gripping fork 33 abuts the shoulder portion 44 and forces the trigger 400, in this embodiment the piston 41, to be displaced towards the second end portion 79. The engagement head 42 is free from the cam lobe 87. Further turning of the adapter 2 will finally force the bunching dart 43 through the compressed gas cylinder 5 and puncture the compressed gas cylinder 5 as described previously. The inflatable device 9 will be filled with compressed gas without activating the primary activation mechanism 8. The gas filled inflatable device 9 will be a clear evidence that somebody has tried to remove the compressed gas cylinder 5. The spiral formed by the spiral flange 26 and the spiral side 27 forms a coarse thread with a large pitch. The threads of the fastening means 23 have a smaller pitch. Therefore the engaging dog 33 is displaced more or faster axially than the adapter 2 when the adapter 2 is turned.

In the second embodiment the trigger 400, in this embodiment the pin 410, is kept in place within the cavity 310 by the adapter 2 when the adapter 2 is in a locking positon. The adapter 2 is in a locking position when the second end portion 29 is abutting the disc seal 77 or close to the disc seal 77. The pointed end 430 abuts and rests on the upper face 24. Turning or unscrewing the adapter 2 displaces the adapter 2 axially. Initially the pointed end 430 rests on the upper face 24 as the displacing means 30, here the spring 480, forces the pin 410 towards the receiving chamber 78 and the upper face 24. At a point of axial displacement of the adapter 2, the pin 410 is free of the support from the upper face 24 and is released into the receiving chamber 78. The spring 480 has the strength to penetrate the pointed end 430 into the compressed gas cylinder 5. Puncturing of the compressed gas cylinder 5 inflates the inflatable device 9 as described previously.

Irrespective of the secondary trigger device 3 comprising the piston 41 as trigger 400 or the pin 410 as trigger 400, the connection device 1 may be fitted into known inflatable devices 9. The compressed gas cylinder 5 is released from the known connection device 10, and the channel 63 replaces the gas cylinder 5 as shown in FIG. 10. The channel 63 is permanently fixed to the connection device 10. The channel 63 may be fixed with a glue such as a thread locker, as described previously. The activation mechanism 800 of the connection device 10 does not have any function anymore, and the releasing cord is therefore removed. This can be done by cutting the releasing cord.

The inflatable device 9 will be filled with compressed gas without activating the primary activation mechanism 8 if somebody tries to remove the compressed gas cylinder 5. The compressed gas will flow through the connection device 1, the channel 63, and enter the inflatable device 9 through the connection device 10.

Maintenance of the inflatable device 9 and/or the releaser 4 may require that the inflatable device 9 and releaser 4 are separated. Thereby the compressed gas cylinder 5 is separated from the inflatable device 9. It may also be necessary to change the compressed gas cylinder 5. According to the invention this requires a change of the releaser 4 and the compressed gas cylinder 5 at the same time.

An embodiment of a coupling up 90 of the inflatable device 9 and the releaser 4 is shown in FIGS. 11A-C-15. The coupling up 90 is designed for authorized separation of the inflatable device 9 from the releaser 4 by use of a release tool 99. The coupling up 90 comprises a flange connection 91 which is fastened to an outer surface 93 of the inflatable device 9 and which surrounds a through opening 95 in the inflatable device 9. The flange connection 91 may be fastened to the inflatable device 9 by a suitable glue. The flange connection 91 comprises a base plate 92 provided with a through opening 925 which is aligned with the through opening 95. A protruding inner sleeve 93 and a protruding outer sleeve 94 surround the through opening 925. The inner sleeve 93 and the outer sleeve 94 are positioned coaxially. The inner sleeve 93 comprises external threads 931.

The inner sleeve 93 and the outer sleeve 94 form between them an annulus 96. The base plate 92 is at a bottom face 960 of the annulus 96 provided with at least one spring hinged catch lever 97. The figures show two catch levers 97. When idle or non-tensioned, a portion of the catch lever 97 is raised above the base plate 92 within the annulus 96. The base plate 92 is at the bottom face 960 provided with a recess 970 which is complementary to the catch lever 97. The catch lever 97 comprises a slide surface 971, a first lock surface 973 and a compression surface 975. The slide surface 971 is substantially parallel to the base plate 92. The lock surface 973 is substantially perpendicular to the base plate 92. The compression surface 975 tapers radially towards the base plate 92 from the inner sleeve 92 towards the outer sleeve 94.

A radially oriented key hole 98 is positioned in the outer sleeve 94. The key hole 98 is formed with an opening with an irregular profile. A release tool 99 comprises a stem 991 and a handle 993. The stem 991 is provided with a tapered tip 995. The stem 991 is formed with a profile that matches the profile of the key hole 98.

The attachment device 6 is on a connection face 62 provided with a connection flange 63. The connection flange 63 surrounds the through opening 61. The connection flange 63 is provided with internal threads 631 which mate with the external threads 931. The flange 63 is further provided with ratchets 67. The ratchets 67 are arranged in a circle on the edge of the connection flange 63. Each rachet 67 is provided with a second lock surface 673 which may be oriented perpendicular to the connection face 62. The rachets 67 form a barbed surface 68.

The attachment device 6 is screwed onto the coupling up 90 by mating the internal threads 631 with the external threads 931. The barbed surface 68 with the rachets 67 slide freely over the slide surface 971 at low resistance. The second lock surface 973 engages the first lock surface 673 and the engagement blocks for unscrewing the attachment device 6. The catch lever is in a blocking position. The attachment 6 is screwed onto the coupling 9 until the edge of the inner sleeve 93 engages a seal which surrounds the through opening 61.

The attachment device 6 is released from the coupling up 90 by use of the release tool 99. When the stem 991 is displaced radially inwards through the key hole 98, the tapered tip 995 engages the compression surface 975 and further displacement of the stem 991 presses the catch lever 97 towards the recess 970 and further into the recess 970. The catch lever is in a disengaged position. The lock surface 973 is thereby not in engagement with the lock surface 673 and the attachment device 6 may be unscrewed. Only authorized personnel equipped with the release tool 99 may unscrew the attachment device 6.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A connection device for connecting a compressed gas cylinder to an inflatable device, where the connection device comprises a releaser providing a fluid connection between the compressed gas cylinder and the inflatable device, the releaser comprises a primary activation mechanism for controlled puncture of the compressed gas cylinder via a piston provided with a bunching dart, said primary activation mechanism is provided with means for axially displacement of the piston towards the compressed gas cylinder, wherein the releaser further comprises:

a rotatable adapter with means for irreversible fastening of the compressed gas cylinder to the adapter;

a secondary trigger device adapted for puncturing the compressed gas cylinder, said secondary trigger device comprising a displacing means for axially displacing a trigger towards the compressed gas cylinder, where the secondary trigger device is in an activated position when the adapter is in an axially displaced position;

wherein the trigger comprises the piston; and the displacing means comprises a release lever connecting the adapter to the piston such that the adapter in the axially displaced position has displaced the release lever and the piston axially towards the compressed gas cylinder and punctured the compressed gas cylinder.

2. The connection device according to claim 1, wherein the adapter is provided with an external spiral groove forming a spiral face, and the release lever is provided with an engaging dog, and the engaging dog abuts the spiral face.

3. The connection device according to claim 2, wherein the release lever is provided with a gripping fork at the opposite end of the engaging dog, and the gripping fork abuts a shoulder portion in the piston.

4. The connection device according to claim 1, wherein the trigger comprises a pin formed with a pointed portion; and the displacing means comprises a spring axially forcing the pointed portion towards the adapter, and wherein the pin in an inactivated position abuts a top face of the adapter in a locking position; and the pin in an activated position is axially displaced towards the pointed portion, such that the spring has axially displaced the pin towards the compressed gas cylinder and punctured the compressed gas cylinder when the adapter is in the axially displaced position.

5. The connection device according to claim 4, wherein the spring is a coil spring forcing towards a spring collar of the pin.

6. The connection device according to claim 1, wherein the connection device comprises an attachment device for fastening the releaser to the inflatable device, wherein the attachment device is connected to the inflatable device via a screw type coupling up, said coupling up comprises a spring hinged catch lever provided with a first lock surface and a number of rachets, and each of the rachets is provided with a second lock surface, said second lock surface is adapted for engagement with the first lock surface, and the spring hinged catch lever is provided with a compression surface which is adapted to engage with a tapered tip of a tool such that the first lock surface is released from the second lock surface.

7. The connection device according to claim 1, wherein the connection device comprises an attachment device for fastening the releaser to the inflatable device, wherein the attachment device is connected to the inflatable device via a screw type coupling up, said coupling up comprises a spring hinged catch lever provided with a first lock surface and a number of rachets, and each of the rachets is provided with a second lock surface, said second lock surface is adapted for engagement with the first lock surface, and the spring hinged catch lever is provided with a compression surface which is adapted to engage with a tapered tip of a tool such that the first lock surface is released from the second lock surface.

8. The connection device according to claim 2, wherein the connection device comprises an attachment device for fastening the releaser to the inflatable device, wherein the attachment device is connected to the inflatable device via a screw type coupling up, said coupling up comprises a spring hinged catch lever provided with a first lock surface and a number of rachets, and each of the rachets is provided with a second lock surface, said second lock surface is adapted for engagement with the first lock surface, and the spring hinged catch lever is provided with a compression surface which is adapted to engage with a tapered tip of a tool such that the first lock surface is released from the second lock surface.

9. The connection device according to claim 3, wherein the connection device comprises an attachment device for fastening the releaser to the inflatable device, wherein the attachment device is connected to the inflatable device via a screw type coupling up, said coupling up comprises a spring hinged catch lever provided with a first lock surface and a number of rachets, and each of the rachets is provided with a second lock surface, said second lock surface is adapted for engagement with the first lock surface, and the spring hinged catch lever is provided with a compression surface which is adapted to engage with a tapered tip of a tool such that the first lock surface is released from the second lock surface.

10. The connection device according to claim 4, wherein the connection device comprises an attachment device for fastening the releaser to the inflatable device, wherein the attachment device is connected to the inflatable device via a screw type coupling up, said coupling up comprises a spring hinged catch lever provided with a first lock surface and a number of rachets, and each of the rachets is provided with a second lock surface, said second lock surface is adapted for engagement with the first lock surface, and the spring hinged catch lever is provided with a compression surface which is adapted to engage with a tapered tip of a tool such that the first lock surface is released from the second lock surface.

11. The connection device according to claim 5, wherein the connection device comprises an attachment device for fastening the releaser to the inflatable device, wherein the attachment device is connected to the inflatable device via a screw type coupling up, said coupling up comprises a spring hinged catch lever provided with a first lock surface and a number of rachets, and each of the rachets is provided with a second lock surface, said second lock surface is adapted for engagement with the first lock surface, and the spring hinged catch lever is provided with a compression surface which is adapted to engage with a tapered tip of a tool such that the first lock surface is released from the second lock surface.

* * * * *